US005536631A

United States Patent [19]

Muessig-Pabst et al.

[11] Patent Number: 5,536,631

[45] Date of Patent: Jul. 16, 1996

[54] FAST-PROCESSING PHOTOGRAPHIC RECORDING MATERIAL FOR MEDICAL RADIOGRAPHY

[75] Inventors: Thomas Muessig-Pabst, Frankfurt; Manfred A. Schmidt, Dietzenbach, both of Germany

[73] Assignee: E. I. Du Pont de Nemours and Company, Wilmington, Del.

[21] Appl. No.: 412,656

[22] Filed: Mar. 28, 1995

[30] Foreign Application Priority Data

Apr. 11, 1994 [DE] Germany ..... 44 12 369.8

[51] Int. Cl.[6] ..... G03C 1/035; G03C 1/005; G03C 1/46

[52] U.S. Cl. ..... 430/567; 430/569; 430/966

[58] Field of Search ..... 430/567, 569, 430/966

[56] References Cited

U.S. PATENT DOCUMENTS

| | | | |
|---|---|---|---|
| 4,425,426 | 1/1984 | Abbott et al. | 430/569 |
| 4,861,702 | 8/1989 | Suzuki et al. | 430/567 |
| 4,897,340 | 1/1990 | Ohtani et al. | 430/966 |
| 4,983,508 | 1/1991 | Ishiguro et al. | 430/569 |

FOREIGN PATENT DOCUMENTS

| | | | |
|---|---|---|---|
| 0271309A2 | 6/1988 | European Pat. Off. | G03C 5/30 |
| 0304908A1 | 3/1989 | European Pat. Off. | G03C 1/02 |
| 0518323A1 | 12/1992 | European Pat. Off. | G03C 5/16 |
| 0518066A1 | 12/1992 | European Pat. Off. | G03C 1/035 |
| 0559061A2 | 9/1993 | European Pat. Off. | G03C 5/26 |
| 4119505A1 | 12/1992 | Germany | G03C 5/16 |
| 93/05442 | 3/1993 | WIPO | G03C 1/035 |

*Primary Examiner*—Mark F. Huff

[57] ABSTRACT

The invention relates to a fast-processing photographic recording material for medical radiography which can be processed within 30 to 60 seconds in a film processor. The recording material comprises a silver halide emulsion layer applied to each side of a carrier; wherein at least one of the silver halide emulsion layers comprises silver halide grains or crystals with a morphology which is chosen from a set consisting of plate-like or platelet shaped, spherical and approximately spherical; and the silver halide emulsion layer is described by the equation:

$$W=N_g/(N_s*N_m)$$

wherein:

$N_g$ is the total number of silver halide crystals per surface unit; $N_s$ is the number of elementary layers of the silver halide emulsion layer; and $N_m$ is the maximum possible number of silver halide crystals of the silver halide emulsion layer that can be contained in an elementary layer; and W is also defined by the equation:

$$W>(0.5-A_r/1000)$$

wherein:

$A_r$ is the weight percentage of the plate-like or platelet shaped silver halide crystals in this silver halide emulsion layer.

24 Claims, No Drawings

FAST-PROCESSING PHOTOGRAPHIC RECORDING MATERIAL FOR MEDICAL RADIOGRAPHY

BACKGROUND OF THE INVENTION

1. Field of the Invention

The subject matter of the invention is a fast-processing photographic recording material for medical radiography, which stands out for its fast processability and high sensitivity while also displaying very good photographic and physical properties.

2. Description of Related Art

Medical radiography makes use of photographic recording materials (called X-ray films below) having at least one radiation-sensitive silver halide emulsion layer on both sides of a carrier in combination with intensifying screens. The physical and photographic properties of these X-ray films determine their suitability in terms of allowing the radiologist to make a reliable diagnosis of diseases. In order to reduce radiation exposure for patients as well as hospital personnel, there is a need for X-ray films which are as sensitive as possible. In addition to the uniform high quality requirements made of today's X-ray films, the fast availability of the image developed from them is also a significant aspect, for example, pictures which are taken during operations and which are needed to provide information on the further course of the surgery. Moreover, in hospitals or large physicians' practices it is often the case that pictures from several imaging devices, for example, X-ray machines, laser cameras, devices for monitoring photography, and copiers for X-ray films, are processed in the same film processor. This is why there is a desire for the highest possible throughput rate for the photographic films and thus the shortest possible processing times—less than 60 seconds—for X-ray films as well as for other photographic films, in film processors in such hospitals and physicians' practices.

The processing time of a photographic film depends primarily on the composition of the film in question, on the structure and on the mode of operation of the particular film processor, as well as on the developer solution and the fixing bath used in the film processor. All of the parameters—for example, the dryer geometry and drying time of the film processor or the absorption of process water by the particular photographic film—which influence the drying of the photographic films in the film processor are of special importance in this context.

The processing time is defined here as the time that an X-ray film in the standard format having edge lengths of 0.35 meter×0.35 meter needs to pass through a film processor, starting when the X-ray film is pulled in and ending with the complete release of the developed X-ray picture. This period of time may also be referred to as the "nose to drop" in the technical literature.

A photographic silver halide recording material is said to be fast-processing if it can be processed in a film processor within 30 to 60 seconds.

U.S. Pat. No. 4,897,340 describes an example of a roll processor as well as a formulation for a developer used in it as well as a fixing bath suitable for this processing.

In order to reduce the processing time of photographic films, U.S. Statutory Invention Registration No. H874 proposes the reduction of the total gelatin coating weight to a range from 2.2 to 3.1 g/m$^3$ per side. However, this has a detrimental effect on certain properties of X-ray films such as, for example, sensitivity to wet pressure marks and scratches, graininess, pressure desensitization and sensitization as well as the image quality of the image made with this material.

As another way to shorten the processing time of X-ray films, it has been suggested to reduce the swelling of the binder by means of greater cross-linking. This measure, however, has a detrimental effect on the photographic properties such as gradation and maximum optical density.

A simultaneous reduction of binder and silver halide application in the recording material leads to a greater print through and thus to worse sharpness of the picture made with this material. This can only be unsatisfactorily compensated for by using filter dyes, since they cannot be completely washed out and thus they have a negative impact on the picture coloration of the X-ray picture made in this manner.

Another way to quickly process X-ray films proposed by U.S. Pat. No. 4,797,353 is to use polymers such as polyacrylamide and/or saccharose which can be washed out during the development process in the silver halide or protective layer.

However, the washable polymers contaminate the processor liquids and are thus disadvantageous. Moreover, such films with a low weight ratio of non-washable binder to silver have poor wet pressure properties.

Until now, no photographic recording material has been found for medical radiology that can be processed within 60 seconds with a film processor, while also displaying an adequately high sensitivity, good physical and photographic properties as well as high image quality.

The photographic recording materials which have been proposed so far for medical radiology and which can be processed within 60 seconds also yield differing sensitometric data as a function of the processing time. This is not desirable in actual practice since different exposure parameters are needed for different processing speeds.

SUMMARY OF THE INVENTION

The objective of the invention is to provide a fast-processing photographic silver halide recording material for medical radiography which displays very good photographic and physical properties, which has increased sensitivity at a defined maximum achievable optical density and which can be processed within 30 to 60 seconds in a roll processor.

Another aspect of the objective is to provide a process for the production of images using the fast-processing silver halide recording materials on a film processor, whereby the processing time should be between 30 and 60 seconds.

The objective is achieved by a fast-processing photographic silver halide recording material for medical radiography, comprising:

a carrier; and a silver halide emulsion layer applied to each side of said carrier, wherein at least one of said silver halide emulsion layers comprises silver halide grains with a morphology which is chosen from a set consisting of platelet or platelet shaped, spherical and approximately spherical, and for said silver halide emulsion layer a parameter W is defined by the equation:

$$W=N_g/(N_s*N_m)$$

wherein:

$N_g$ is a total number of silver halide grains per surface unit;

$N_s$ is a number of elementary layers of the silver halide emulsion layer;

$N_m$ is a maximum possible number of silver halide grains of the silver halide emulsion layer that can be contained in an elementary layer;

W is greater than $(0.5-A_r/1000)$; and $A_r$ is a weight percentage of the platelet or platelet shaped silver halide grains relative to the total silver halide grains in said silver halide emulsion layer.

A preferred embodiment is provided in a fast-processing photographic silver halide recording material for medical radiography, comprising:

a carrier; and a silver halide emulsion layer applied to each side of said carrier, said silver halide emulsion layer contains at least one silver halide crystal with a morphology which is chosen from a set consisting of essentially spherical and approximately spherical, and for at least one of said silver halide emulsion layers a parameter W is defined by the equation:

$$W=N_g/(N_s*N_m)$$

wherein:

$N_g$ is a total number of silver halide grains per surface unit;

$N_s$ is a number of elementary layers of the silver halide emulsion layer;

$N_m$ is a maximum possible number of silver halide grains of the silver halide emulsion layer that can be contained in an elementary layer; and W is greater than 0.5.

Yet another preferred embodiment is provided in a fast-processing photographic silver halide recording material for medical radiography, comprising;

a carrier; and a silver halide emulsion layer applied to each side of said carrier, at least one of said silver halide emulsion layers contains platelet or platelet shaped silver halide grains, and for at least one of said silver halide emulsion layers a parameter W is defined by the equation:

$$W=N_g/(N_s*N_m)$$

wherein:

$N_g$ is a total number of silver halide grains per surface unit;

$N_s$ is a number of elementary layers of the silver halide emulsion layer;

$N_m$ is a maximum possible number of silver halide grains of the silver halide emulsion layer that can be contained in an elementary layer; and W is greater than 0.4.

DESCRIPTION OF THE PREFERRED EMBODIMENT(S)

In Formula 1, an upper limit for W is preferably 0.9. A preferred lower limit for W is 0.6 for layers containing essentially spherical and/or approximately spherical silver halide grains and 0.45 for layers containing essentially platelet or platelet shaped silver halide grains.

The silver halide grains in the silver halide emulsion can have a regular grain or crystal shape such as, for example, cubes, octahedrons, cubo-octahedrons, or a less regular shape such as plates, simple twins with (111) and/or (100) bounding faces or spheres. Moreover, silver halide emulsions can also contain mixtures of at least two of these crystal shapes.

Silver halide crystals or grains for which the average ratio of the largest to the smallest dimension (aspect ratio) lies between 1.1:1.0 and 2.0:1.0 are defined as approximately spherical. Examples of such silver halide grains are cubes, octahedrons, cubo-octahedrons and simple twins with (111) and/or (100) bounding faces.

Spherical silver halide grains have a ratio of largest to the smallest dimension that is between 1.1:1.0 and 1.0:1.0. Platelet or platelet shaped silver halide grains have an aspect ratio of at least 2.0:1.0.

The mean grain diameter of a spherical or approximately spherical silver halide emulsion refers to the diameter of a sphere which is the same as the mean grain volume. This makes it possible to suitably compare different grain shapes which constitute approximately spherical silver halide grains such as cubes, simple twins with (111) and/or (100) bounding faces or octahedral, among each other as well as with spherical silver halide grains.

In the case of platelet or platelet shaped silver halide grains with an aspect ratio of at least 2.0:1.0, in contrast, only the mean grain thickness of the platelet or platelet shaped silver halide grains is suitable to define the layer thickness of the elementary layer. The grain thickness and the edge length of the platelet or platelet shaped silver halide grains can be determined, for instance, by measuring images of such silver halide grains generated by means of a scanning electron microscope.

The mean grain diameter of a silver halide emulsion can be measured by means of various methods such as, for example, by means of scanning electron microscopic images of such an emulsion. The mean grain volume of a silver halide emulsion can be determined by means of the process described in German Patent no. 2,025,147.

The layer thickness of the emulsion layer of a photographic recording material is controlled by the silver application and the binder quantity in the silver halide emulsion. It can be determined, for example, by using an electron microscope in order to examine a cross section of the recording material to be studied.

The layer thickness of the elementary layer of an emulsion layer is defined as equal to the diameter of a sphere that has a volume equal to the mean grain volume of the corresponding spherical or approximately spherical silver halide emulsion, or equal to the grain thickness when platelet or platelet shaped silver halide emulsions are used. If a mixture of at least two spherical and/or approximately spherical silver halide emulsions is used, then the layer thickness of the elementary layer is defined accordingly as being equal to the diameter of a sphere that has a volume equal to the mean grain volume of the corresponding spherical and/or approximately spherical silver halide emulsion.

If a mixture of at least one spherical and/or approximately spherical silver halide emulsion and at least one platelet or platelet shaped silver halide emulsion is used, then the layer thickness of the elementary thickness results from the sum of the mean grain thickness of the platelet or platelet shaped silver halide emulsion or emulsions and the mean diameter of a sphere that is has a volume equal to the mean grain volume of the corresponding spherical and/or approximately spherical silver halide emulsion or emulsions, each multiplied by the value of the percentage by weight and divided by 100.

In such a silver halide emulsion, the smallest parameter W that can be used according to the invention depends on the weight ratio between the platelet or platelet shaped and the spherical and/or approximately spherical silver halide grains.

The number of elementary layers of a silver halide emulsion layer, represented by $N_s$, is defined as the quotient of the layer thickness of the silver halide emulsion layer and the layer thickness of the elementary layer.

The total number of silver halide grains per surface unit, represented by $N_g$, is defined as the silver halide coating weight per surface unit, divided by the product of the mean grain volume and the density of the silver halide grains.

The maximum possible number of silver halide grains of the silver halide emulsion layer, represented by $N_m$, that can be contained in one surface unit of the elementary layer is defined as the number of silver halide grains whose combined projection surface areas are equal to the surface area of the corresponding surface unit. In the case of platelet or platelet shaped silver halide grains, the average largest possible projection surface of the silver halide grains is used to calculate $N_m$.

The projection surfaces of silver halide emulsion grains can be measured, for instance, by means of pictures of such emulsions taken with an electron microscope. In order to calculate $N_m$, in the case of spherical or approximately spherical silver halide emulsions, it is also possible to assume an approximately circular surface area with the mean grain diameter of the emulsion as being the mean projection surface.

When approximately spherical silver halide emulsions are used, it is preferable to use those whose mean grain volume ranges from 0.08 $\mu m^3$ to 0.30 $\mu m^3$. Special preference is given to silver halide emulsions consisting of spherical silver halide grains.

When platelet or platelet shaped silver halide emulsions are used, it is preferable to use those whose silver halide grains have a mean grain diameter between 0.8 μm to 2.0 μm and which have a ratio of grain diameter to grain thickness between 2:1 and 7:1 on the average. In this context, the mean grain diameter of platelet or platelet shaped silver halide emulsions is defined as the diameter of the circle that is equal in area to the surface of an averaged plate surface.

The binder application for silver halide emulsion layers lies between 0.5 $g/m^2$ and 5.0 $g/m^2$, for protective layers between 0.5 $g/m^2$ and 2.0 $g/m^2$, and for intermediate layers between 0.1 $g/m^2$ and 2.0 $g/m^2$.

It is preferable to apply hydrophilic binders in the silver halide emulsion layers according to the invention in such a way that a weight ratio of the coating weight of hydrophilic binders in the silver halide emulsion layer to the silver coating weight of said silver halide emulsion layer lies between 0.35 and 0.75 where the parameter W is as defined herein.

Silver coating weight refers to the weight of silver in the form of its ions in the layers containing silver halide grains with respect to the surface unit of the photographic silver halide material. The values for the silver coating weight are expressed in grams per square meter and they refer to the sum of all of the layers of the recording material containing silver halide.

The silver coating weight usually lies in the range between 2.5 $g/m^2$ and 8 $g/m^2$. In a preferred embodiment, the fast-processing silver halide recording material has a silver coating weight of at least 4.9 $g/m^2$. Particularly preferred is a silver coating weight of at least 5.2 $g/m^2$.

The photographic silver halide recording material can contain several different layers on both sides of the substrate such as, for example, bonding layers, protective layers, intermediate layers, emulsion layers, anti-static layers as well as layers containing dyes.

The layer that is furthest from the substrate and does not contain any silver halide is designated as the protective layer. In addition to hydrophilic binders and surface-active substances, such protective layers can optionally also contain other substances which influence the chemical, physical and mechanical properties of the X-ray film. Examples of these substances are lubricants, surface-active substances containing perfluoro-alkyl groups, latices (polymer organic particles), fine-particle crystalline $SiO_2$ dispersions, matting agents (spacers), hardeners, anti-static substances as well as preservatives.

The preferred protective colloid used for the silver halide grains in the emulsion layer and hydrophilic binder is alkalinically disintegrated bovine bone gelatin. It can be ion-exchanged.

In addition, it is also possible to use other hydrophilic binders in the various layers of the silver halide recording material. Examples of hydrophilic binders are synthetic polymers such as polymers or copolymers made of vinyl alcohol, N-vinyl pyrrolidone, acrylamide, acrylic acid, methacrylic acid, vinyl imidazole, vinyl pyrazole as well as natural polymers such as casein, gelatin (acidically or alkalinically disintegrated, made of bovine bones or pigskins), cellulose and cellulose derivatives, alginates, albumin, starch, as well as modified polymers such as hydroxy ethyl cellulose, hydrolyzed gelatin, chemically modified gelatin as described, for example, in U.S. Pat. No. 5,087,694, chemically modified and hydrolyzed gelatin as described, for example, in German Patent no. 2,166,605 and U.S. Pat. No. 3,837,861.

The photographic silver halide recording material can contain the hydrophilic binder in the emulsion layers as well as in additional auxiliary layers such as, for instance, protective layers, adhesive layers or intermediate layers.

In addition to the hydrophilic binders, additional binders can be present in the layers of the photographic recording material. Examples of such binders are matting agents or latices (polymer organic particles), which are incorporated into the corresponding coating solution in the form of aqueous dispersions, usually stabilized by wetting agents.

The photographic emulsions can be produced according to various methods from soluble silver salts and soluble halides.

During the production and/or physical ripening of the silver halide emulsion, metal ions such as, for example, those of cadmium, zinc, thallium, mercury, iridium, rhodium and iron or their complexes can be present.

The silver halide emulsion can contain silver halide grains consisting of silver bromide, silver bromo-iodide, silver chlorobromo-iodide or silver chlorobromide. Preferably, a silver halide emulsion is used which contains silver bromo-iodide with a proportion of 3% iodide, with respect to the halide proportion.

After crystal formation has been completed, or else already at an earlier point in time, the soluble salts are removed from the emulsion, for example, by noodle-washing, by flocculation and washing, by ultrafiltration or by means of ion exchanging.

The silver halide emulsion is generally subjected to a chemical sensitization under defined conditions—pH, pAg, temperature, gelatin concentration, silver halide concentration and sensitizer concentration—until the sensitivity and fog optimum values are reached. With the chemical sensitization, chemical sensitizers can be used such as, for example, active gelatin, sulfur, selenium or tellurium compounds, salts or complexes of gold, platinum, rhodium, palladium, iridium, osmium, rhenium, ruthenium, either alone or in combination. Processes are described, for instance, in H. Frieser, "Die Grundlagen der Photographischen Prozesse mit Silberhalogeniden" (The principles of photographic processes with silver halides), pages 674 through 734, published by Akademische Verlagsgesellschaft (1968) or in T. H. James, The Theory of the Photographic Process, 4th edition, Macmillan Publishing Co., Inc., New York, pages 149 through 160, and in the publications cited therein.

For the production of the photographic silver halide recording materials according to the invention, the layers containing hydrophilic binders can also contain organic or inorganic hardeners. The hardening of a layer can also be brought about in that the layer to be hardened is coated with a layer containing a diffusable hardening agent such as described, for example, in DE-A 3,836,945. The hardener can be added in the course of the production of emulsion solutions and/or of casting solution for auxiliary layers. Another possible mode of addition is the injection of a solution of the hardener into at least one emulsion or coating solution during its transport from the supply vessel to the coating installation. Suitable solvents for this purpose are, in addition to water, other organic solvents that are miscible with water such as ethanol, acetone, dimethyl sulfoxide or 1,4-dioxane. In order to stabilize the hardener solution, substances or substance mixtures can be present which adjust and/or buffer the pH value of the hardener solution.

Examples of such hardeners that can be used in photographic recording materials are chromium salts such as chromium alum, aldehydes such as formaldehyde, glyoxal and glutaric dialdehyde, N-methylol compounds such as N,N'-dimethylol urea, compounds with reactive vinyl groups such as 1,3-bis-(vinyl sulfonyl)-2-propanol, bis-(vinyl sulfonyl) methyl ether, N,N'-N"-tris-acryloyl hexahydrotriazine, polymeric hardeners such as, for example, those described in U.S. Pat. No. 4,508,818, 1,3-bis-carbamoyl imidazolium compounds such as those described in DE-B 4,119,982 or carbamoyl pyrimidinium compounds such as those described, for example, in U.S. Pat. No. 3,880,665.

Preferably, a quantity of hardener is used which leads to an absorption of process water by the fast-processing silver halide recording material of less then 20 g/m$^2$. Special preference is given to the use of a quantity of hardener that leads to an absorption of process water by the fast-processing silver halide recording material of less then 16 g/m$^2$.

The silver halide emulsion can contain spectral sensitizers such as, for instance, cyanine dyes, merocyanine dyes, hemicyanine dyes, and styryl dyes. Spectral sensitizers can be used either alone or in combination.

The layers of the photographic recording material can contain substances to stabilize the emulsion against fog formation or to stabilize other photographic properties; these substances can include, for example, bromide, benzothiazolium salts, nitroindazoles, nitrobenzimidazoles, mercaptothiazoles, mercaptobenzothiazoles, mercaptobenzimidazoles, mercaptothiadiazoles, chlorobenzimidazoles, bromobenzimidazoles, aminotriazoles, benzotriazoles, nitrobenzotriazoles, mercaptopyrimidine, mercaptotriazine, thioketo compounds such as, for example, oxazolinthione, azaindolizines such as triazaindolizines and tetraazaindolizines, like the especially preferred 5-hydroxy-7-methyl-1,3,4-tetraazaindene, and mercaptotetrazoles such as, for instance, 1-phenyl-5-mercaptotetrazole on their own or in combination with other substances of this group.

The silver halide emulsion as well as the mixtures for the production of the auxiliary layers can contain surface-active substances for various purposes, such as coating aids for preventing electrostatic charging, for improving the gliding properties, for emulsifying the dispersion, for preventing adhesion and for improving photographic characteristics (for example, development acceleration, high contrast, sensitization). In addition to natural surface-active compounds such as, for example, saponin, mainly synthetic surface-active compounds (surfactants) are used, such as non-ionic surfactants containing oligo- or polyoxyalkylene groups, glycerin compounds and glycidol compounds, cationic surfactants, for example, higher alkylamines, quaternary ammonium salts, pyridine compounds, and other heterocyclic compounds, sulphonium compounds or phosphonium compounds, anionic surfactants containing an acid group, for example, a carboxylic acid ester group, a phosphoric acid ester group, a sulfuric acid ester group or a phosphoric acid ester group, ampholytic surfactants such as, for example, amino acid and amino sulfonic acid compounds as well as sulfuric acid ester and phosphoric acid ester of an amino alcohol.

The layers of the photographic recording material can contain filter dyes such as oxonol dyes, hemioxonol dyes, styryl dyes, merocyanine dyes, anthraquinone dyes, cyanine dyes, azomethine dyes, triaryl methane dyes, phthalocyanines and azo dyes.

The carrier of the photographic recording material can consist of a transparent plastic sheet and optionally of a plastic sheet dyed blue. This plastic sheet can be made, for example, of plastics such as polyethylene terephthalate, cellulose acetate, cellulose acetate butyrate, polystyrene or polycarbonate.

The surface of the carrier is preferably treated by means of a corona discharge before its first coating in order to improve the adhesion properties.

Various casting processes can be used for the production of the photographic recording material. Examples of these are curtain casting, cascade casting, immersion casting, rinse casting, slot-die casting. If desired, several layers can be applied at the same time.

A general overview of photographic silver halide emulsions, their production, additives, processing and use is given in Research Disclosure, Vol. 308, Number 308119 (December 1989) and the sources cited in it. [Research Disclosure is published by Kenneth Mason Publications Ltd., Dudley Annex, 21a North Street, Elmsworth, Hampshire P010 7DQ, England.]

The fast-processing photographic silver halide recording material according to the invention also has a higher resolution, better image color (bluer silver image), improved mechanical strength of the emulsion layer as well as lower noise when compared with the state of the art.

In an advantageous manner, the fast-processing photographic silver halide recording material according to the invention for medical radiography also displays a comparable sensitometry after processing in 90 seconds or after fast processing.

EXAMPLES

Seven silver halide emulsions using spherical silver bromide-iodide grains (2% iodine proportion) having a mean grain diameter of 0.56 μm were produced. The ratio of the individual weight percentages of hydrophilic binders in the silver halide emulsion to silver is shown in Table 1 in grams of hydrophilic binder per 1.5 mole of silver. Each of the seven emulsions were applied together with a mixture used in order to produce a protective layer and, using formaldehyde as the hardener, they were applied onto a polyester substrate provided with an adhesive layer and dried in such a way that a protective layer was formed over the emulsion layer. Subsequently, the same layers were applied in the same manner onto the back side of the samples and dried so that the front and back had an identical layer structure and layer composition, each consisting of an emulsion layer and a protective layer. In this process, the quantity of hardener used and the wet coating weight of the individual layers were selected in such a way that the values described in Table 1 were reached for W, for the layer thickness and for the silver application (with respect to the silver contained in the two emulsion layers), and values given for the absorption of process water in Table 2 were found for the seven samples V1, V2 and E1 through E5 as well as the gelatin coating weight of the protective layer of 1.0 g/m$^2$ for each side.

Moreover, two silver halide emulsions were made using spherical silver bromide iodide grains (2% iodine proportion) having a mean grain diameter of 0.75 μm and three silver halide emulsions using platelet or platelet shaped silver bromide iodide grains (2% iodine proportion) having a mean grain volume of 0.17 μm$^3$, a mean grain thickness of 0.18 μm and a mean grain diameter of 1.1 μm. The ratio of the appertaining weight proportion of hydrophilic binders in the silver halide emulsion to silver is likewise given in Table 1. The emulsions were applied onto a carrier, together with a mixture in order to produce a protective layer, essentially containing gelatin and located above the emulsion layer and, using formaldehyde as the hardener, for the films VG1 and EG1 (spherical silver halide grains) as well as for the films with platelet or platelet shaped silver halide grains VT, ET1 and ET2, in such a way that the values given in Table 1 were reached for W, for the layer thickness, for the silver application (with respect to the silver contained in the two emulsion layers) and the values given for the absorption of process water are shown in Table 2. The gelatin coating weight of the protective layer was 1.0 g/m$^2$ on each side.

The numerical mean value of the grain diameter, calculated as the mean diameter of the spheres which were equal in volume to the silver halide grains, was measured with a device as specified in German Patent no. 2,025,147.

The absorption of process water by the film samples was determined by first taking a sheet of the recording material to be examined and exposing it over its entire surface to an intensity corresponding to the saturation range of the characteristic curve, then processing it with a roll processor (Kodak Processor, Type M8), in which the rear cover and the upper deflection roll behind the wash section were removed, filled with a developer solution and with a fixing bath having the following composition:

| Developer | |
|---|---|
| Hydroquinone | 24.0 g/l |
| Phenyl pyrazolidone | 0.75 g/l |
| Sodium sulfite, anhydrous | 60.0 g/l |
| Sodium metaborate | 33.0 g/l |
| Sodium hydroxide | 19.0 g/l |
| Potassium bromide | 10.0 g/l |
| 6-nitrobenzimidazole | 0.5 g/l |

-continued

| Developer | |
|---|---|
| Disodium salt of ethylene diamine tetraacetic acid | 3.5 g/l |
| Glutaric aldehyde sodium bisulfite | 15.0 g/l |
| Sufficient water to reach a volume of 1 liter | |

| Fixing bath | |
|---|---|
| Ammonium thiosulfate | 130.0 g/l |
| Sodium sulfite, anhydrous | 10.0 g/l |
| Boric acid | 7.0 g/l |
| Acetic acid (90% by weight) | 5.5 g/l |
| Sodium acetate trihydrate | 25.0 g/l |
| Aluminum sulfate × 18 $H_2O$ | 9.0 g/l |
| Sulfuric acid (60% by weight) | 5.0 g/l |
| Sufficient water to reach a volume of 1 liter | |

by means of the RP process (90 seconds passage time; developing bath temperature 34° C. [93.2° F.]) and removed immediately after the washing, weighed in the wet state, dried and weighed in the dry state. The weight difference, divided by the surface, is given as the absorption of process water by the recording material in grams of water per square meter of film.

In addition to the comparison films and the films according to the invention, in the same manner, four commercially available photographic silver halide recording materials for radiography, M1 to M4, were examined. M1 and M2 contain essentially platelet or platelet shaped silver halide grains whereas M3 and M4 contain approximately spherical silver halide grains.

Table 2 shows the measured values for the absorption of process water, the system sensitivity and the processing time. Moreover, the evaluation of the properties of image silver color, resolution and noise after visual inspection is given. The resolution is given as lines per millimeter and it was determined by exposing the sample to be studied to X-rays in an X-ray cassette with intensifying screens through an appropriate original (lead grid), by developing it in a film processor and by visually searching for the number of lines that were just barely visible.

TABLE 1

| Sample | Binder emulsion layer (g/1.5 mol silver) | Silver coating weight (g/m2) | Layer thickness emulsion layer (μm) | W | |
|---|---|---|---|---|---|
| V1 | 185 | 4.4 | 3.3 | 0.46 | Comparative |
| VG1 | 150 | 5.2 | 3.7 | 0.48 | Comparative |
| V2 | 155 | 4.0 | 2.8 | 0.51 | Comparative |
| VT1 | 160 | 4.4 | 3.2 | 0.32 | Comparative |
| ET1 | 100 | 5.2 | 2.5 | 0.50 | Inventive |
| ET2 | 80 | 5.2 | 2.3 | 0.54 | Inventive |
| E1 | 105 | 4.0 | 2.2 | 0.70 | Inventive |
| E2 | 110 | 5.1 | 2.8 | 0.64 | Inventive |
| E3 | 75 | 5.1 | 2.4 | 0.75 | Inventive |
| E4 | 55 | 5.1 | 2.1 | 0.85 | Inventive |
| E5 | 55 | 5.6 | 2.3 | 0.86 | Inventive |
| EG1 | 110 | 5.8 | 3.1 | 0.63 | Inventive |
| M1 | — | 3.8 | 3.0 | 0.31 | Comparative |
| M2 | — | 4.4 | 3.7 | 0.27 | Comparative |
| M3 | — | 4.7 | 3.3 | 0.47 | Comparative |
| M4 | — | 4.9 | 3.8 | 0.46 | Comparative |

TABLE 2

| Sample | Absorption of process water (g/m2) | Sensitivity | Process time (sec) | Image silver coloration | Resolution (lines/mm) | Noise |
|---|---|---|---|---|---|---|
| V1 | 24 | 100% | 90 | 0 | 5.3 | medium |
| VG1 | 27 | 200% | 100 | – | 4.0 | very high |
| V2 | 21 | 105% | 80 | 0 | 5.3 | medium |
| VT1 | 23 | 140% | 90 | — | 4.5 | high |
| ET1 | 15 | 160% | 45 | + | 5.3 | medium |
| ET2 | 14 | 180% | 40 | + | 5.5 | medium |
| E1 | 17 | 120% | 58 | 0 | 5.3 | low to medium |
| E2 | 15 | 115% | 45 | ++ | 5.7 | very low |
| E3 | 14 | 145% | 38 | + | 5.7 | low |
| E4 | 12 | 185% | 30 | + | 5.7 | low to medium |
| E5 | 11 | 185% | 30 | ++ | 6.0 | low |
| EG1 | 16 | 210% | 45 | + | 5.0 | high |
| M1 | 16 | 100% | 38 | 0 | 5.0 | low to medium |
| M2 | 17 | 115% | 38 | 0 | 4.5 | low to medium |
| M3 | 17 | 135% | 45 | 0 | 4.5 | medium to high |
| M4 | 18 | 100% | 38 | 0 | 4.3 | medium to high |

In evaluating the image silver coloration, the symbols stand for the following: ++ very good (blue); + good; 0 adequate; – poor; — very poor (brown).

The sensitometric data of the samples produced was obtained by means of standardized exposure and processing in a roll processor using the above-described developer as well as the fixing bath. The values for the gradients of the samples do not differ by more than 10%, whereas the measured maximum density values were on average 3.8, with deviations of less than 6%.

Tables 3 and 4 show the same sensitometry of the individual samples according to the invention with a processing time of 90 and 53 seconds.

TABLE 3

| Film sample | VG1 | | EG1 | |
|---|---|---|---|---|
| Processing time [s] | 90 | 53 | 90 | 53 |
| Sensitivity [%] | 100 | (93) | 110 | 107 |
| D-max [%] | 100 | (92) | 92 | 94 |
| Mean gradient [%] | 100 | (103) | 93 | 90 |

A comparison is shown of important sensitometric data with processing times of 90 and 53 seconds of the two film samples VG1 and EG1. The values in parentheses do not indicate comparable data since the corresponding samples were wet when they came out of the film processor.

TABLE 4

| Film sample | V1 | | E2 | |
|---|---|---|---|---|
| Processing time [s] | 90 | 53 | 90 | 53 |
| Sensitivity [%] | 100 | (100) | 115 | 110 |
| D-max [%] | 100 | (100) | 96 | 95 |
| Mean gradient [%] | 100 | (90) | 100 | 98 |

A comparison is shown of important sensitometric data with processing cycles of the two film samples V1 and E2. The values in parentheses do not indicate comparable data since the corresponding samples were wet when they came out of the film processor.

What is claimed is:

1. A fast-processing photographic silver halide recording material for medical radiography comprising:

a carrier; and a silver halide emulsion layer applied to each side of said carrier, wherein at least one of said silver halide emulsion layers comprises silver halide grains with a morphology which is chosen from a set consisting of platelet, spherical and approximately spherical, and for said silver halide emulsion layer a parameter W is defined by the equation:

$$W=N_g/(N_s*N_m)$$

wherein:

$N_g$ is the total number of silver halide grains per square meter;

$N_s$ is the number of elementary layers of the silver halide emulsion layer; and $N_m$ is the maximum possible number of silver halide grains of the silver halide emulsion layer that can be contained in an elementary layer per square meter and also $$W>(0.5-A_r/1000), \text{ (and)}$$

wherein:

$A_r$ is the weight percentage of the silver halide grains relative to the total silver halide grains in said silver halide emulsion layer, wherein said silver halide recording material has a total silver halide coating weight of not less than 4.9 g/m$^2$.

2. The fast-processing photographic silver halide recording material of claim 1, wherein said spherical silver halide grains or said approximately spherical silver halide grains have a mean grain volume of at least 0.08 μm$^3$ and no more than 0.30 μm$^3$.

3. The fast-processing photographic silver halide recording material of claim 2, wherein at least one of said silver halide layers contains spherical silver halide grains.

4. The fast-processing photographic silver halide recording material of claim 1, wherein at least one of said silver halide layers contains spherical silver halide grains.

5. The fast-processing photographic silver halide recording material of claim 1, wherein said platelet silver halide grains have a mean grain diameter of 0.8 μm to 2.0 μm and a ratio of the mean grain diameter to a mean grain thickness of 2:1 to 7:1.

6. The fast-processing photographic silver halide recording material of claim 1, wherein absorption of process water by said silver halide recording material is below 20 g/m$^2$.

7. The fast-processing photographic silver halide recording material of claim 6, wherein said absorption of process water by said silver halide recording material is below 16 g/m$^2$.

8. The fast-processing photographic silver halide recording material of claim 1, wherein a ratio of weight of hydrophilic binder in the silver halide emulsion layer to weight of silver in the silver halide emulsion layer lies between 0.35 and 0.75.

9. The fast-processing photographic silver halide recording material of claim 1 wherein at least one said silver halide emulsion layers comprises silver halide grains with a morphology which is chosen from the group consisting of platelet, spherical and approximately spherical wherein the mean grain volume of said platelet, spherical, or said approximately spherical silver halide grain is at least 0.08 μm$^3$ and no more than 0.30 μm$^3$.

10. A fast-processing photographic silver halide recording material for medical radiography comprising:

a carrier; and a silver halide emulsion layer applied to each side of said carrier; said silver halide emulsion layer comprises at least one silver halide grain with a morphology which is chosen from the group consisting of spherical and approximately spherical; and for at least one of said silver halide emulsion layers a parameter W is defined by the equation:

$$W=N_g/(N_s*N_m)$$

wherein:

$N_g$ is the total number of silver halide grains per square meter;

$N_s$ is the number of elementary layers of the silver halide emulsion layer; and $N_m$ is the maximum possible number of silver halide grains of the silver halide emulsion layer that can be contained in an elementary layer per square meter; and W is greater than 0.5, wherein said silver halide recording material has a total silver halide coating weight of not less than 4.9 g/m$^2$.

11. The fast-processing photographic silver halide recording material of claim 10, wherein W is at least 0.6 and no more than 0.9.

12. The fast-processing photographic silver halide recording material of claim 11, wherein at least one of said silver halide layers contains spherical silver halide grains.

13. The fast-processing photographic silver halide recording material of claim 10, wherein a mean grain volume of said spherical silver halide grains or said approximately spherical silver halide grains is at least 0.08 μm$^3$ and no more than 0.30 μm$^3$.

14. The fast-processing photographic silver halide recording material of claim 10, wherein at least one of said silver halide layers contains spherical silver halide grains.

15. The fast-processing photographic silver halide recording material of claim 10, wherein absorption of process water by said silver halide recording material is below 20 g/m$^2$.

16. The fast-processing photographic silver halide recording material of claim 15, wherein said absorption of process water by said silver halide recording material is below 16 g/m$^2$.

17. The fast-processing photographic silver halide recording material of claim 10, wherein a ratio of weight of hydrophilic binder in the silver halide emulsion layer to weight of silver in the silver halide emulsion layer lies between 0.35 and 0.75.

18. A fast-processing photographic silver halide recording material for medical radiography comprising:

a carrier; and a silver halide emulsion layer applied to each side of said carrier;

wherein at least one of said silver halide emulsion layers contains platelet silver halide grains; and for at least one said silver halide emulsion layers, a parameter W is defined by the equation:

$$W=N_g/(N_s*N_m)$$

wherein:

$N_g$ is the total number of silver halide grains per square meter, $N_s$ is the number of elementary layers of the silver halide emulsion layer;

$N_m$ is the maximum possible number of silver halide grains of the silver halide emulsion layer that can be contained in an elementary layer per square meter; and W is greater than 0.4, wherein said silver halide recording material has a total silver halide coating weight of not less than 4.9 g/m$^2$.

19. The fast-processing photographic silver halide recording material of claim 18, wherein W is at least 0.45 and no more than 0.9.

20. The fast-processing photographic silver halide recording material of claim 19 wherein said platelet silver halide grains have a mean grain diameter of 0.8 μm to 2.0 μm and a ratio of the mean grain diameter to mean grain thickness of 2:1 to 7:1.

21. The fast-processing photographic silver halide recording material of claim 18 wherein said platelet silver halide grains have a mean grain diameter of 0.8 μm to 2.0 μm and a ratio of the mean grain diameter to a mean grain thickness of 2:1 to 7:1.

22. The fast-processing photographic silver halide recording material of claim 18, wherein absorption of process water by said silver halide recording material is below 20 g/m$^2$.

23. The fast-processing photographic silver halide recording material of claim 22, wherein said absorption of process water by said silver halide recording material is below 16 g/m$^2$.

24. The fast-processing photographic silver halide recording material of claim 18, wherein a ratio of weight of hydrophilic binder in the silver halide emulsion layer to weight of silver in the silver halide emulsion layer lies between 0.35 and 0.75.

* * * * *